US005445284A

United States Patent [19]

Guest

[11] Patent Number: 5,445,284

[45] Date of Patent: Aug. 29, 1995

[54] CONTAINER CLOSURES

[75] Inventor: John H. Guest, West Midlands, United Kingdom

[73] Assignee: MCG Closures Limited, United Kingdom

[21] Appl. No.: 979,402

[22] Filed: Nov. 19, 1992

Related U.S. Application Data

[63] Continuation of Ser. No. 754,646, Sep. 4, 1991, abandoned.

[30] Foreign Application Priority Data

Sep. 5, 1990 [GB] United Kingdom ..... 9019359

[51] Int. Cl.[6] ..... B65D 41/34

[52] U.S. Cl. ..... 215/252; 215/31

[58] Field of Search ..... 215/250, 252, 253, 256, 215/258, 31

[56] References Cited

U.S. PATENT DOCUMENTS

| | | | |
|---|---|---|---|
| 2,175,350 | 10/1939 | Hammer | 215/252 |
| 2,280,724 | 4/1942 | Sharp | 215/252 |
| 2,367,317 | 1/1945 | Thomas | 215/252 |
| 3,303,955 | 2/1967 | Osborne et al. | 215/252 |
| 3,335,889 | 8/1967 | Brumme | 215/252 |
| 3,348,718 | 10/1967 | Musy | 215/252 |
| 3,455,479 | 7/1969 | Hadley et al. | 215/252 |
| 3,465,907 | 9/1969 | Dorn et al. | 215/256 |
| 3,589,544 | 6/1971 | Hannon | 215/252 |
| 3,750,821 | 8/1973 | Sourbet et al. | 215/252 |
| 3,910,443 | 10/1975 | Hadley | 215/252 |
| 4,572,387 | 2/1986 | Luker et al. | 215/252 |
| 4,658,976 | 4/1987 | Pohlenz | 215/252 |
| 4,771,904 | 9/1988 | Perne et al. | 215/252 |
| 4,805,792 | 2/1989 | Lecinski, Jr. | 215/253 |
| 4,878,589 | 11/1989 | Webster et al. | 215/252 |
| 4,915,244 | 4/1990 | Celaschi et al. | 215/252 |
| 4,957,211 | 9/1990 | Ekkert et al. | 215/230 |
| 5,009,323 | 4/1991 | Montgomery et al. | 215/252 |
| 5,111,947 | 5/1992 | Patterson | 215/256 |

*Primary Examiner*—Allan N. Shoap
*Assistant Examiner*—Vanessa Caretto
*Attorney, Agent, or Firm*—Laubscher & Laubscher

[57] ABSTRACT

The screw-thread neck of a container, e.g. a glass bottle, has a closure with a tamper-evident ring connected to the lower end of the skirt of the closure by frangible bridges. Opposite the ring, the neck finish of the container has a nose-shaped projection the upper and lower flanks of which meet in a sharp edge, and has an annular groove below the projection. The bridges are formed in an inwardly facing groove above the projection and are radially spaced from the outer surface of the neck finish. The tamper-evident ring is swaged into close contact with the projection, is deformed into a channel on the neck finish below projection, and is closely engaged with the surface of the neck finish below the channel. Interference involving outward prying movement by a lever on the lower edge portion of the ring to disengage the ring from groove causes a pivoting action about the tip of projection leading to fracture of the bridges.

9 Claims, 3 Drawing Sheets

CONTAINER CLOSURES

This application is a continuation of Ser. No. 07/754,646 filed Sep. 4, 1991, now abandoned.

BACKGROUND OF THE INVENTION

This invention relates to container closures and more particularly to closures of the kind made from a malleable metal, e.g. aluminium alloy, having a tamper evident band and intended to be applied to a container neck by a roll-on technique.

SUMMARY OF THE INVENTION

According to this invention, in one aspect there is provided in combination, a container having a neck finish extending about a central axis of the container which neck finish provides a container mouth and an external screw thread adjacent the mouth. An annular outward projection is spaced below the screw-thread and is nose-shaped in cross-section, the projection having a lower flank disposed at a small angle to a plane normal to the central axis and an upper flank extending at a larger angle to the plane, the upper and lower flanks meeting in substantially a sharp edge, and an annular groove below the projection and a roll-on metal closure comprising a top. A dependent skirt and a tamper-evident ring are formed in one piece with the skirt and connected to the lower edge of the skirt by a series of frangible bridges. The skirt is deformed into engagement with the screw thread on the neck finish and the ring is deformed into close contact with the nose-shaped projection on the container and into engagement in the groove below the projection. The bottom edge portions of the ring are deformed into close contact with the surface of the container, and the bridges are radially spaced from the outer surface of the container.

According to a preferred feature of the invention, the lower end portion of the skirt and the upper end portion of the ring jointly provide a radially inwardly facing groove. The bridges are formed in a wall of the groove which is radially spaced from the outer surface of the neck finish. Preferably, the whole of the end portions of the skirt and ring are radially spaced from the outer surface of the neck finish.

In another aspect the invention provides a container having a neck finish extending about a central axis of the container which neck finish provides a container mouth, an external screw thread adjacent the mouth, and an annular outward projection which is spaced below the screw-thread and which is nose-shaped in cross-section. The projection has a lower flank disposed at a small angle to a plane normal to the central axis and an upper flank extending at a larger angle to said plane, the upper and lower flanks meeting in substantially a sharp edge.

The invention further provides a closure or closure blank made from sheet metal and comprising a top, a dependent skirt and a tamper-evident ring formed in one piece with the skirt and connected to the lower edge of the skirt by a series of frangible bridges. The ring is formed adjacent the bridges with an annular grooved formation a portion of which is capable of forming an annular fulcrum in conjunction with a complementary annular surface of a container to which the closure or closure blank is to be applied. Radially outward force applied to the free lower edge portion of the ring causes the bridges and the portion of the ring above the groove to be deformed radially inwardly, the bridges being radially spaced outward from the external surface of the container when the closure or closure blank is positioned thereon.

BRIEF DESCRIPTION OF THE FIGURES

Some embodiments of the invention will now be described by way of example with reference to the accompanying diagrammatic drawings in which.

DETAILED DESCRIPTION

Figure 3:
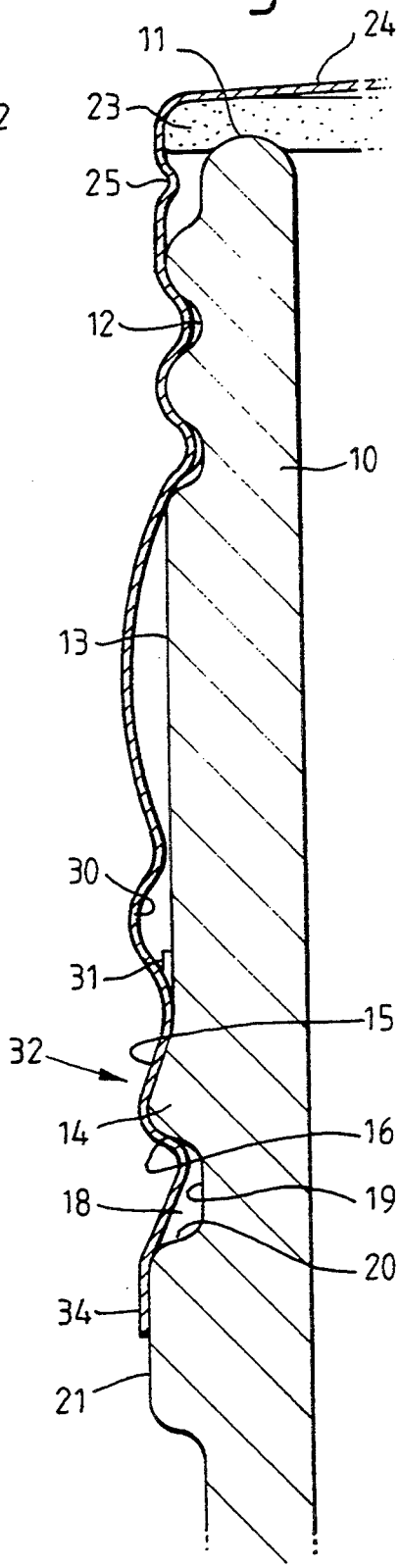
FIG. 3 is a fragmentary sectional elevation of the container and the applied closure on an enlarged scale.

Referring first to FIG. 3, the neck finish 10 of a glass bottle has an upper end surface 11, the edges of which are radiussed, and an adjacent helical groove 12 providing a screw-thread. Below the screw-thread, the external surface of the neck has a plain cylindrical portion 13 at the lower end of which is an annular projection 14 of generally triangular or nose-like form. The upper surface 15 of projection 14 is inclined downward and outward at an angle not greater than about 70° to a plane normal to the central axis Y of the bottle, and the lower surface 16 is as nearly at right angles to the central axis of the bottle as is practicable having regard to the need to be able to disengage the neck finish from the mould. The angle should preferably not exceed 12° to said plane. The corner between surfaces 16 and 15 will in practice be radiussed but should be as sharp as molding techniques can contrive, subject to avoidance of splintering. The surface 16 extends inward beyond the cylindrical portion 13 and forms also the upper wall of an annular groove 18 having a generally cylindrical base wall 19 and a lower wall 20. From the radially outer edge of the wall 20, the external surface of the neck finish extends downward as a plain cylindrical surface 21 of substantially the same diameter as the projection 14.

Figure 1:
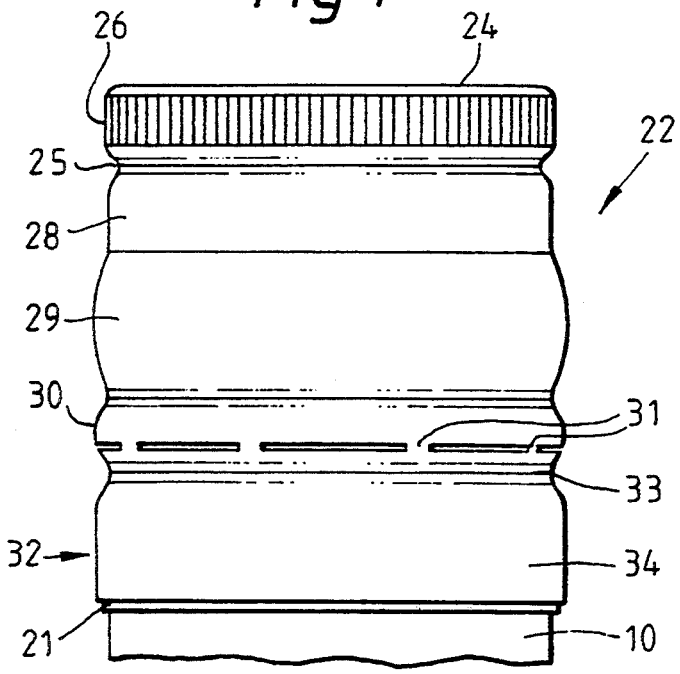
FIG. 1 shows in elevation a container and closure blank according to the invention, FIG. 2 corresponds to FIG. 1 but shows the closure in its fully applied state.

FIG. 1 shows a closure blank 22 resting on the neck of the container prior to the roll-on procedure. The blank has a compressible sealing gasket 23 disposed against the underside of its top 24, as shown in FIG. 3 and retained in place by an impressed annular rib or groove 25. The part 26 of the skirt above the rib 25 is knurled to provide a grip. Below the rib 25, the skirt has a short cylindrical portion 28 which will be rolled into conformity with the screw-thread groove 12, a longer convexly curved portion 29, and an inwardly facing groove 30, in the lower flank of which a ring of frangible bridges 31 is formed. The bridges effectively define the upper edge of a tamper-evident ring 32. Below the groove 30 is an outwardly facing groove 33, the upper flank of which is constituted by the lower flank of groove 30. Below groove 33, the bottom parts 34 of the ring are of plain cylindrical form and have a diameter such as to be a close fit about the cylindrical surface portion 21. To apply the closure to the neck, the closure blank is pressed downward to form a seal between the upper end 11 of the container and the gasket 23 and simultaneously rolling operations are carried out to swage portions of the skirt of the blank and tamper-evident ring into conformity with the profile of the neck finish. On completion of swaging, the relationship between the neck finish and the closure is as shown in FIG. 3. Portion 28 then has a screw-thread profile, the base of groove 33 is disposed firmly in engagement with the surface of the bottle above the nose-shaped projection 14, and the bottom parts 34 are rolled into conformity with the nose-shaped projection 14 and the plain cylindrical surface 21 of the neck finish.

Any attempt to remove the closure without breaking the bridges 31 which involves the insertion of e.g., a blade-like implement between the bottom edge of the ring to disengage the ring from groove 18 will cause the bottom portions of the ring to pivot outward initially about the tip of the nose-shaped projection 14 and then about the base of groove 33. This action immediately places stress on the bridges 31 and causes them to fracture.

Figure 4:
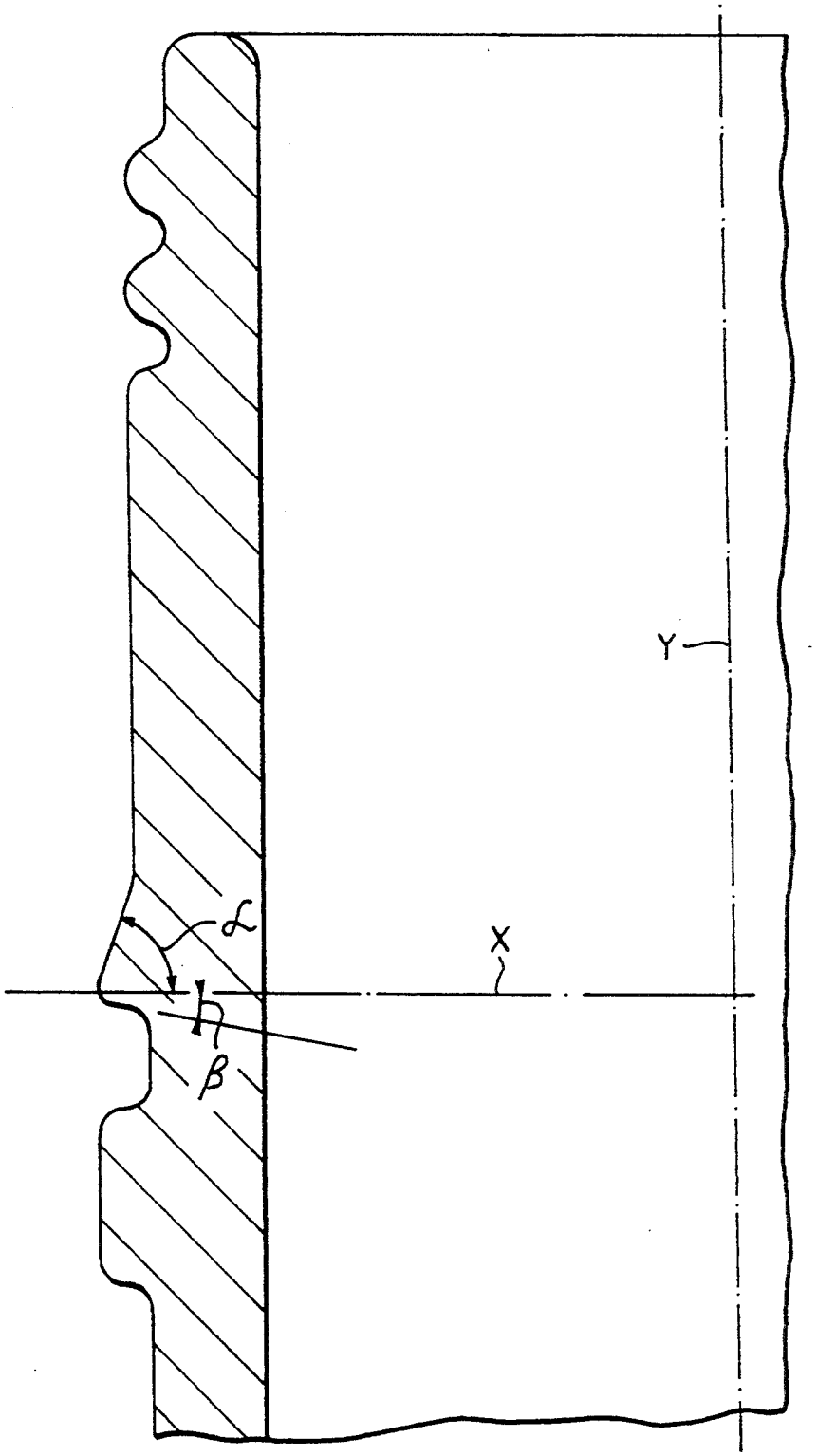
FIG. 4 is a fragmentary axial sectional view of the neck finish of the container shown in FIG. 3, and FIGS. 5, 6 and 7 are views corresponding to FIGS. 1 to 3, respectively, illustrating a second embodiment of the invention.

Referring to FIG. 4, the angle $\alpha$ of the upper flank of the nose-shaped projection 14 relative to a plane X normal to the center line Y of the neck finish is preferably not greater than about 70°, and the angle $\beta$ of the lower flank of the projection is preferably not greater than 12°. It is preferred also that the distance between the top of the closure and the frangible bridges should be between 0.8 and 0.9 of the distance between the top and the projection 14. It is further preferred that the distance between the top of the closure and the frangible bridges should be between 0.6 and 0.75 of the overall height of the closure.

Figure 2:
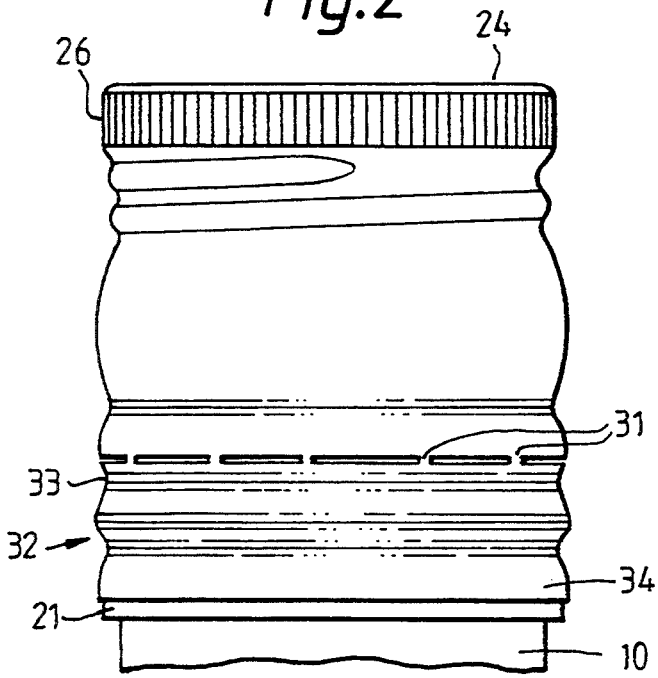
Figure 5:
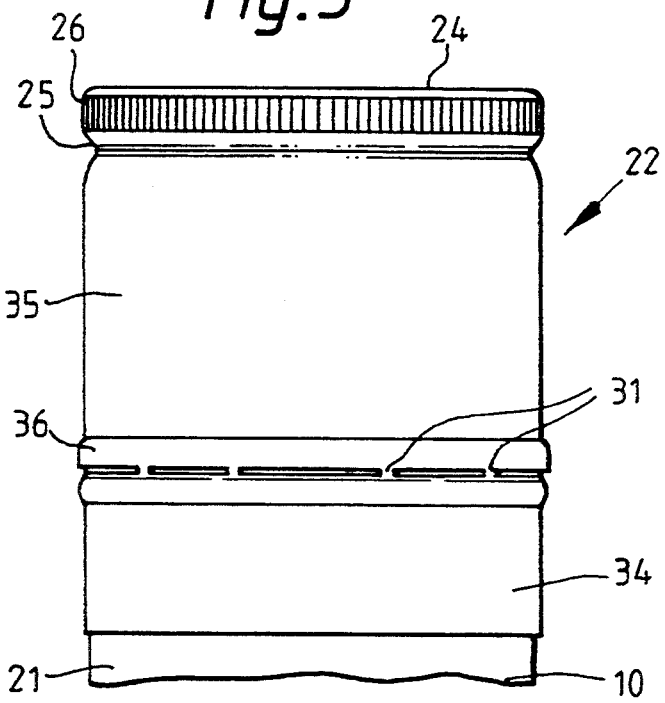
Figure 6:
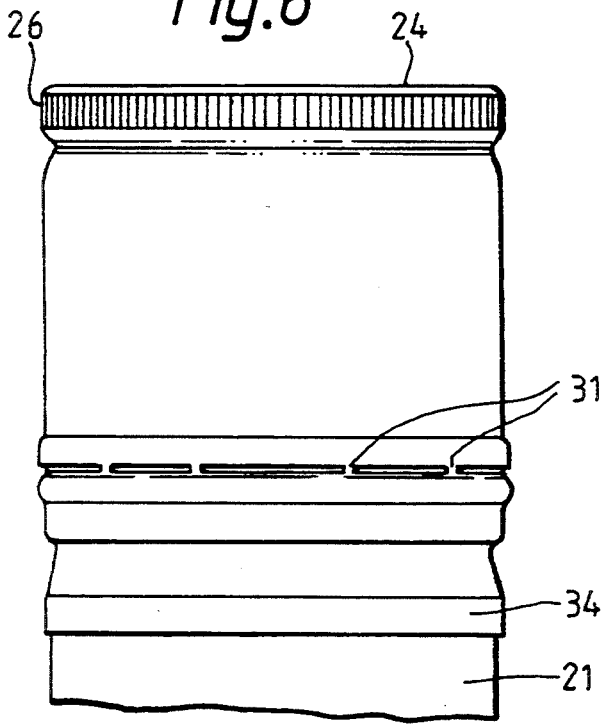
Figure 7:
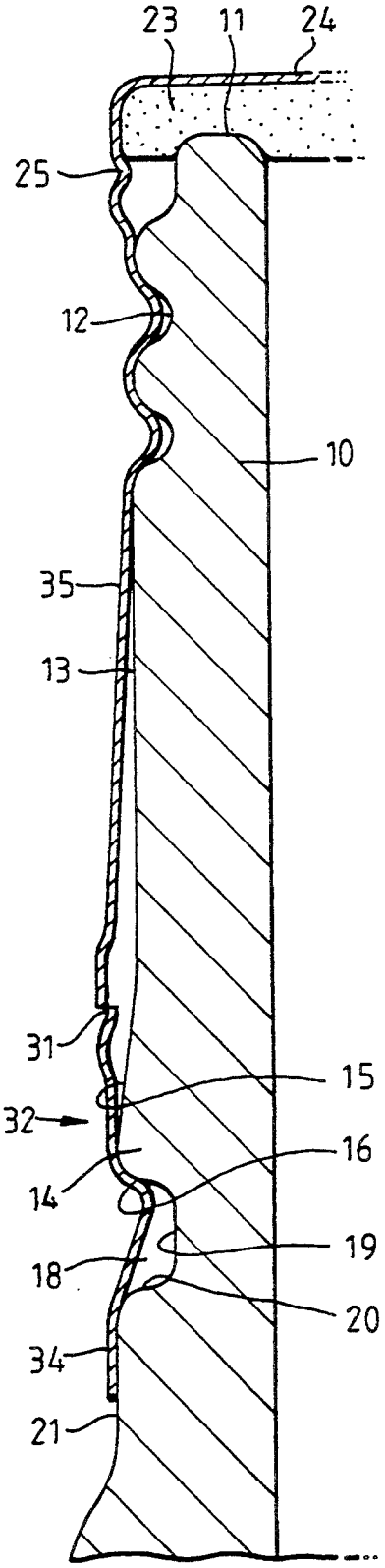

FIGS. 5 to 7 are views of a second embodiment of the invention and correspond respectively to FIGS. 1 to 3. Corresponding parts in the two embodiments are indicated by the same reference numerals. The neck finish in the embodiment of FIGS. 5 to 7 is similar but not identical to that of FIGS. 1 to 3. The angle of the surface 15 of the nose-shaped projection 14 is inclined at about 70° relative to plane X which is normal to the (vertical) axis of the bottle. A substantial length 35 of the skirt below the external groove 25 is of plain cylindrical form. Below the cylindrical part 35 is a relatively wide but shallow inwardly facing groove 36 in the middle of the base of which the bridges 31 are formed.

The application of the closure to the neck finish is carried out in manner broadly similar to that described in relation to the arrangement of FIGS. 1 to 3. The upper part of portion 35 is swaged into conformity with the screw-thread groove 12 and the portions of the tamper-evident ring 32 below groove 36 are swaged into conformity with the outermost parts of the projection 14. The bottom edge portion of the ring is pressed into close engagement with the surface of the container. The bridges remain spaced away from the neck finish.

The insertion of e.g. a levering instrument under the bottom edge portion of the ring to disengage the ring from groove 18 results in inward pivotal movement of the portions of the ring about the tip of the nose-shaped projection 14, the tip of the projection acting as a fulcrum. Since the bridges are radially spaced from the external surface of the neck finish, the radially inward movement of the adjoining parts of the ring places the bridges under stress and they fracture.

I claim:

1. A tamper-evident container closure system, comprising (a) a container, including (1) a neck portion extending about a central axis of said container and defining a container mouth and an external screw thread adjacent said mouth;

(2) an annular outward projection spaced below said screw thread and having a nose-shaped cross-sectional configuration, said projection having a lower surface disposed at a first angle with respect to a plane normal to the container central axis and having an upper surface arranged at a second angle with respect to the said normal plane, said upper and lower surfaces meeting at an edge; and (3) said container including an annular groove below said projection; and (b) a roll-on metal closure, including (1) a top;

(2) a skirt depending from said top and having a lower edge portion;

(3) a unitary tamper-evident ring integral with said skirt and having an upper edge portion, said skirt lower edge portion and said ring upper edge portion jointly defining a radially outwardly facing rib; and (4) a plurality of frangible bridges formed in a wall of said rib and connecting said ring upper edge portion with said skirt lower edge portion, said bridges being spaced from said container projection in a direction toward said closure top and being radially spaced from an outer surface of said container, said bridges being located intermediate an axial length of said rib to define upper and lower surfaces of said rib, said skirt deformed into engagement with said screw thread such that said ring is deformed into contact with said projection and into said groove below said projection, whereby said deformed ring forms an annular fulcrum in conjunction with said projection, said ring being pivotable at respective contacting surfaces of said ring and said projection such that a sufficient radially outward force applied to a bottom edge portion of said ring causes said bridges and a portion of said ring above the contacting surfaces of said ring and said projection to deform radially inwardly, a base portion of said rib lower surface constituting said contacting surface of said ring.

2. A container closure system as defined in claim 1, where said skirt lower edge portion and said ring upper edge portion are radially spaced from said container neck surface.

3. A container closure system as defined in claim 1, wherein the distance between said closure top and said frangible bridges is between 0.8 and 0.9 of the distance between said closure top and said projection.

4. A container closure system as defined in claim 1, wherein the distance between said closure top and said frangible bridges is between 0.6 and 0.75 of the overall height of said closure.

5. A container closure system as defined in claim 1, wherein said projection has upper and lower surfaces with said upper surface inclined at an angle up to 70° to said normal plane.

6. A container closure system as defined in claim 1, wherein said projection has upper and lower surfaces with said lower surface extending at an angle of up to 12° to said normal plane.

7. A container closure system as defined in claim 1, wherein said radially outwardly facing rib has a lower surface containing said frangible bridges.

8. A container closure system as defined in claim 1, wherein the diameter of a substantially cylindrical surface provided on said container below said groove and the diameter of the said projection are substantially equal.

9. A container closure system as defined in claim 1, wherein said ring bottom edge portion is deformed into contact with said container below said groove.

* * * * *